US006729106B2

(12) United States Patent
Wiley

(10) Patent No.: US 6,729,106 B2
(45) Date of Patent: May 4, 2004

(54) ORBITAL PALLET WRAPPING MACHINE AND METHOD

(76) Inventor: Robert B. Wiley, 4589 N. Wabash Rd., Marion, IN (US) 46952

( * ) Notice: Subject to any disclaimer, the term of this patent is extended or adjusted under 35 U.S.C. 154(b) by 0 days.

(21) Appl. No.: 10/172,300

(22) Filed: Jun. 13, 2002

(65) Prior Publication Data

US 2002/0189210 A1 Dec. 19, 2002

Related U.S. Application Data

(60) Provisional application No. 60/298,554, filed on Jun. 15, 2001.

(51) Int. Cl.[7] ..... B65B 13/10
(52) U.S. Cl. ..... 53/399; 53/588; 53/556
(58) Field of Search ..... 53/588, 399, 556, 53/441; 493/299, 300; 100/14, 27, 28

(56) References Cited

U.S. PATENT DOCUMENTS

| | | | | |
|---|---|---|---|---|
| 3,230,123 A | * | 1/1966 | Christensen | 493/300 |
| 4,050,220 A | | 9/1977 | Lancaster et al. | |
| 4,067,174 A | | 1/1978 | Goldstein | |
| 4,079,565 A | | 3/1978 | Lancaster, III et al. | |
| 4,109,445 A | | 8/1978 | Shulman | |
| 4,110,957 A | | 9/1978 | Lancaster et al. | |
| 4,166,348 A | | 9/1979 | Carlson | |
| 4,178,734 A | | 12/1979 | Lancaster et al. | |
| 4,317,322 A | | 3/1982 | Lancaster et al. | |
| 4,497,159 A | | 2/1985 | Lancaster, III | |
| 4,524,568 A | | 6/1985 | Lancaster et al. | |
| 4,545,182 A | | 10/1985 | McDowell, Jr. | |
| 4,549,388 A | | 10/1985 | Lancaster | |
| 4,553,374 A | | 11/1985 | Lancaster et al. | |
| 4,593,518 A | | 6/1986 | Lancaster | |
| 4,631,898 A | | 12/1986 | Brambilla | |
| 4,676,048 A | | 6/1987 | Lancaster et al. | |
| 4,712,354 A | | 12/1987 | Lancaster et al. | |
| 4,761,934 A | | 8/1988 | Lancaster | |
| 4,905,448 A | * | 3/1990 | Plitt | 53/588 |
| 4,953,336 A | | 9/1990 | Lancaster, III et al. | |
| 4,979,358 A | | 12/1990 | Keip | |
| 5,140,800 A | | 8/1992 | Martin et al. | |
| 5,155,970 A | | 10/1992 | Moore | |
| 5,282,347 A | | 2/1994 | Cleine et al. | |
| 5,285,891 A | | 2/1994 | Keip | |
| 5,311,725 A | | 5/1994 | Martin et al. | |

(List continued on next page.)

FOREIGN PATENT DOCUMENTS

| | | | |
|---|---|---|---|
| DE | 2430269 | * | 2/1975 |
| DE | 34 31 628 A1 | | 3/1986 |
| EP | 0 388 561 A2 | | 9/1990 |

OTHER PUBLICATIONS

Website printout, dated Nov. 10, 2000, http://www.highlightindustries.com "Welcome to Highlight".
Website printout, dated Nov. 10, 2000, http://www.kaufmanengsys.com/products "Kaufman Engineering—Products".

(List continued on next page.)

*Primary Examiner*—John Sipos
(74) *Attorney, Agent, or Firm*—Renner, Otto, Boisselle & Sklar, LLP

(57) ABSTRACT

A stretch-wrapping machine consists of a revolving ring with a packaging material dispenser mounted to it. The ring revolves about a horizontal axis to dispense the stretch wrap material around a load that is supported by a forklift. The revolving ring is mounted on a track that allows the ring to travel back and forth in a direction perpendicular to the ring. This allows the machine to wrap any load that fits within the ring. Thus the length and the weight of the load do not limit the wrapping capability of the machine.

12 Claims, 5 Drawing Sheets

U.S. PATENT DOCUMENTS

| | | | | | |
|---|---|---|---|---|---|
| 5,404,691 | A | | 4/1995 | Scherer | |
| 5,423,163 | A | | 6/1995 | Wendt | |
| 5,522,203 | A | | 6/1996 | Lancaster, III et al. | |
| 5,623,808 | A | | 4/1997 | Franklin et al. | |
| 5,636,496 | A | * | 6/1997 | Pietila | 53/556 |
| 5,749,206 | A | | 5/1998 | Moore et al. | |
| 5,850,726 | A | | 12/1998 | Degrasse et al. | |
| 5,875,617 | A | | 3/1999 | Scherer | |
| 5,966,904 | A | | 10/1999 | Peters | |
| 6,151,863 | A | * | 11/2000 | Lancaster | 53/588 |
| 6,170,228 | B1 | | 1/2001 | Zeman, III | |
| 6,195,961 | B1 | * | 3/2001 | Turfan | 53/556 |

OTHER PUBLICATIONS

Website printout, dated Nov. 10, 2000, http://www.ciratec.com/prod04.htm "Stretch wrap equipment, machines, photos".

Website printout, dated Nov. 15, 2000, http://www.pacmatic.com/menu1.html "PACMATIC—Robopac, compacta".

Website printouts, dated Nov. 15, 2000, http://itwmima.com "ITW Mima—stretch wrapping systems".

Brochure, ITWMima, "Semiautomatic Stretch Wrapping System".

Website printouts, dated Nov. 10, 2000, http://www.wulftec.com/english/maineng.htm "Wulftec International".

Brochure, Wulftec International, "Run With the Pack".

Website printout, 1998–1999, "Welcome to INFRA Pak".

Website printout, dated Nov. 10, 2000, http://www.highlightindustries.com, "Revolver".

Brochure, Highlight Industries, Inc., "Synergy 2".

Brochure, Cousins Packaging Inc., "Fully Automatic Stretch Wrap Systems".

Advertisement, Orion Packaging Inc., "World Class Performers".

Advertisement, Kalamazoo Packaging Systems, " Twister".

Advertiseent, Lantech.com, "Stretch Wrappers. Palletizers. Conveyor Systems".

Advertisement, Ciratec Corp., "Orbital Stretch Wrappers".

Advertisement, Lung Meng Packaging Machinery, "Complete Line of Semi–Automatic & Fully Automatic Packaging Machines".

Advertisement, Möllers North America, Inc., "The Protection of Shrinkwrap".

Advertisement, ITW Mima,"World's Largest Manufacturer".

Advertisement, Infra Technical, Inc.

Advertisement, Slidell Inc., "Turnkey Packaging Solutions".

Brochure, Infrapak Stretch Wrapping Systems, "Sidewinder Orbital".

Website printout, dated Nov. 15, 2000, http://www.itwmima.com/eqiup–auto–h65.html "ITW Mima—Equipment/Automatic".

Website printouts, dated Nov. 15, 2000, http://www.lantech.com/products/lr/lrmain.html "Lantech: Welcome to Lantech".

* cited by examiner

ORBITAL PALLET WRAPPING MACHINE AND METHOD

RELATED APPLICATION DATA

This application claims the benefit under 35 U.S.C. § 120 of U.S. Provisional Application No. 60/298,554, filed on Jun. 15, 2001.

FIELD OF THE INVENTION

This invention relates to a packaging machine and method and is particularly related to a machine and method for wrapping one or more goods on a pallet with a packaging wrap material for shipping and storage.

BACKGROUND OF THE INVENTION

Many packaging methods have been utilized to securely wrap a load for transportation, storage, and stabilization. One of the methods used involves a stretch wrapping machine, which wraps a packaging material, such as a stretch wrap, around the load. These machines come in a variety of configurations including both manual and automatic units. The selection of an appropriate machine generally is dependent on application and cost.

Stretch wrap machines generally rotate at least one of the stretch wrap dispenser and the load. For example, the machine may either move the stretch wrap dispenser around a stationary load or move the load on a turntable or conveyor in front of or past a stationary stretch wrap dispenser.

SUMMARY OF THE INVENTION

Applicant has recognized several limitations and disadvantages in prior stretch wrap machines, including the inability to wrap long items, high cost, large space utilization, and lack of flexibility by not being movable. In addition, many stretch wrap machines have limitations on at least one of the dimension and the weight of the load to be wrapped. The present invention provides an orbital stretch wrap machine that overcomes most, if not all, of these limitations.

More particularly, the present invention provides an orbital stretch wrap machine that includes a stretch wrap dispenser movable around a load in a wrapping plane, and also movable in a travel direction generally transverse to the wrapping plane. This enables the machine to wrap loads of varying size. The load is not supported by the machine and thus the machine is not limited by the weight of the load. In addition, because the dispenser is movable along the travel direction, the length of the loads is not a limitation on the machine.

In one embodiment of the invention, the dispenser is mounted on a rotatable ring and the load is extended into the ring for wrapping. The ring defines the wrapping plane and is mounted on a track for movement in the travel direction. The only limitation on the size of the load is that it must fit within the ring.

By allowing the wrapping ring to move back and forth on the track, the machine can wrap loads of any length with minimal or no movement of the material handling equipment. If the load is extremely long (longer than the length of travel of the ring on the track), additional track can be added, and the invention can wrap loads of an almost infinite length without moving the load.

Consequently the machine moves the wrapping material about the load in both the horizontal axis and vertical axis and does not move the load. The load's weight is of no moment to the machine. If the material handling equipment can lift the load, the machine can wrap it.

Another feature of the invention is the efficient compact size of the orbital wrapping machine. Consequently, the machine can be moved from location to location with little effort. It can even be mounted on one or more wheels or casters, to make movement easier. This makes installation a simple process that saves both time and money.

The foregoing and other features of the invention are hereinafter fully described and particularly pointed out in the claims, the following description and annexed drawings setting forth in detail a certain illustrative embodiment of the invention, this embodiment being indicative, however, of but one of the various ways in which the principles of the invention may be employed.

DETAILED DESCRIPTION

The present invention provides a packaging wrap system and machine that moves a supply of wrapping material both in a substantially vertical plane around the circumference of a load and in a travel direction along the length of the load to wrap loads of varying lengths. The load is supported by a material handling device rather than the machine, and thus the weight of the load is not a limitation on the capacity of the machine. In addition, because the supply of wrapping material is movable in the travel direction, the wrapping capability of the machine also is not limited by the length of the load.

Figure 1:
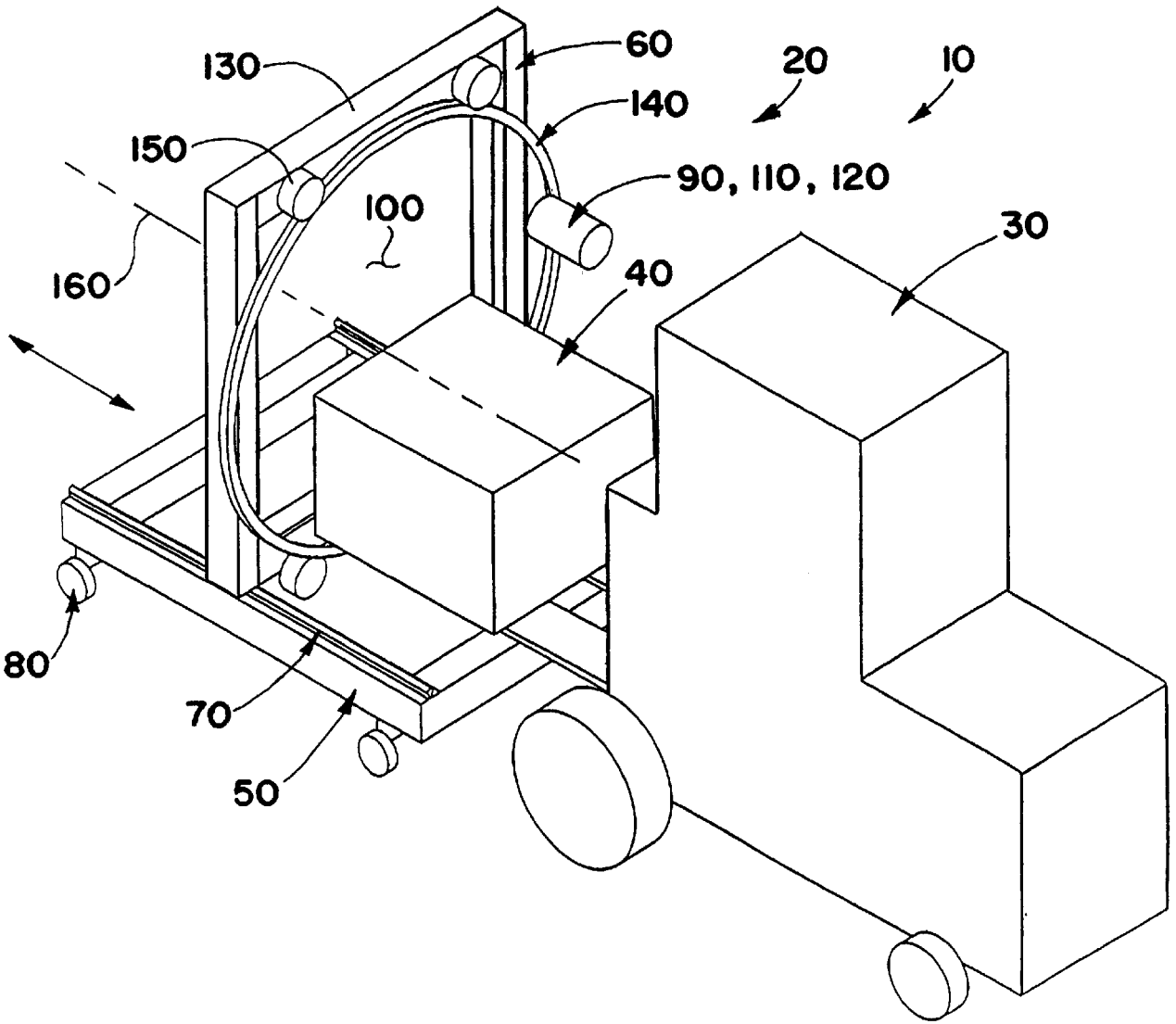
FIG. 1 is an isometric view of the wrapping machine provided by the present invention with a load presented for wrapping.
Figure 2:
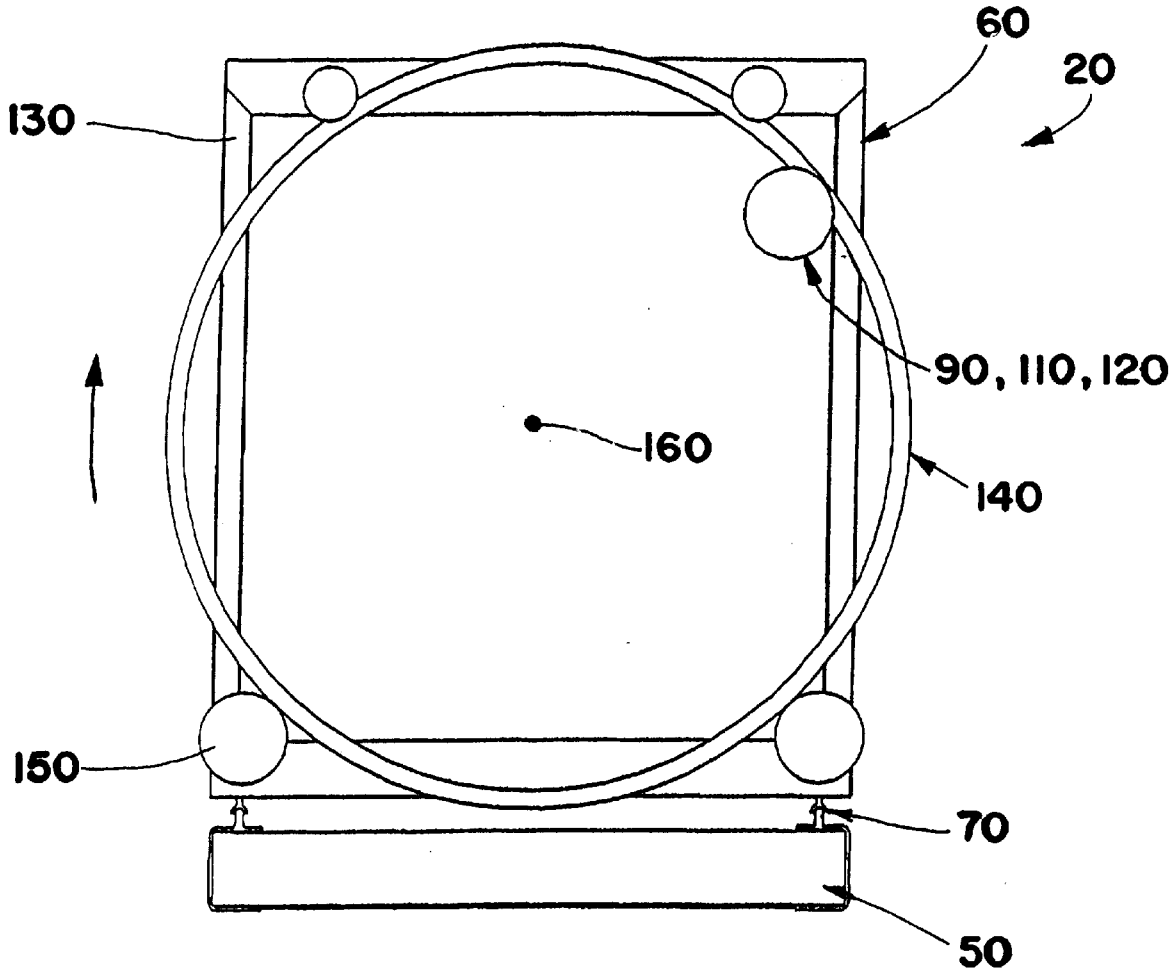
FIG. 2 is a front view of the wrapping machine.
Figure 3:
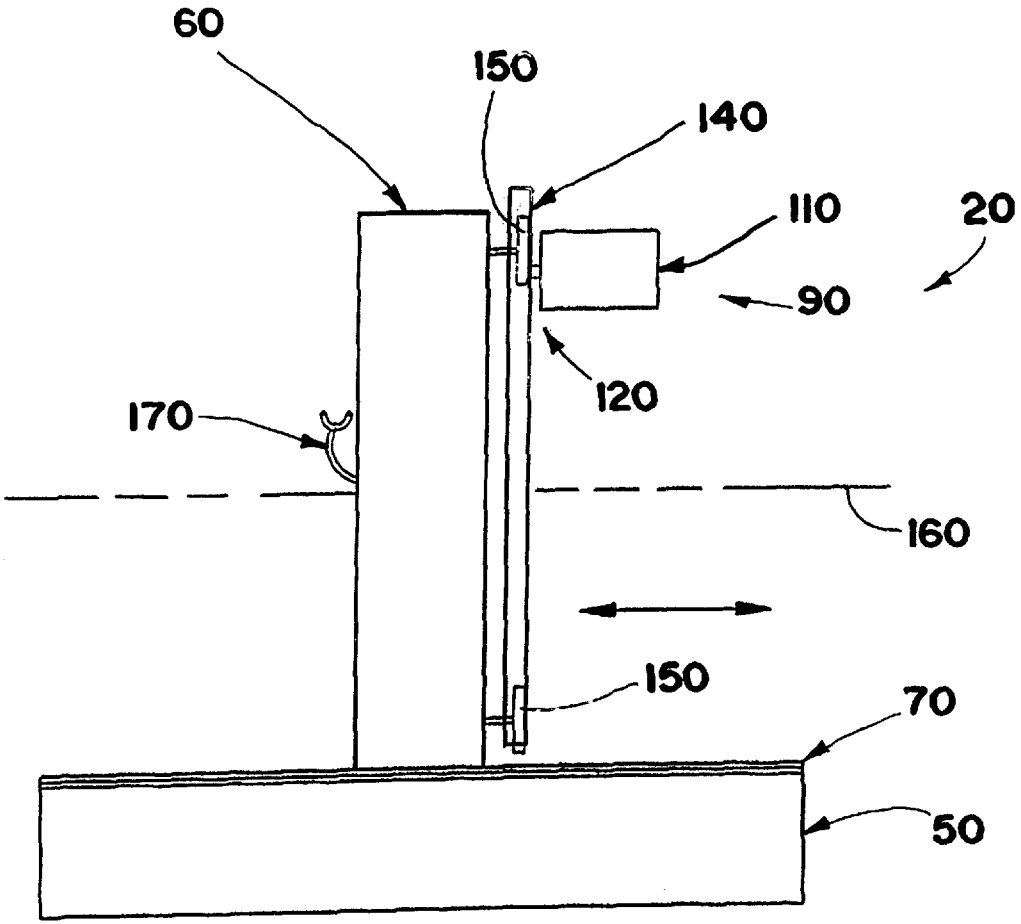
FIG. 3 is a side view of the wrapping machine shown in FIG. 1.
Figure 4:
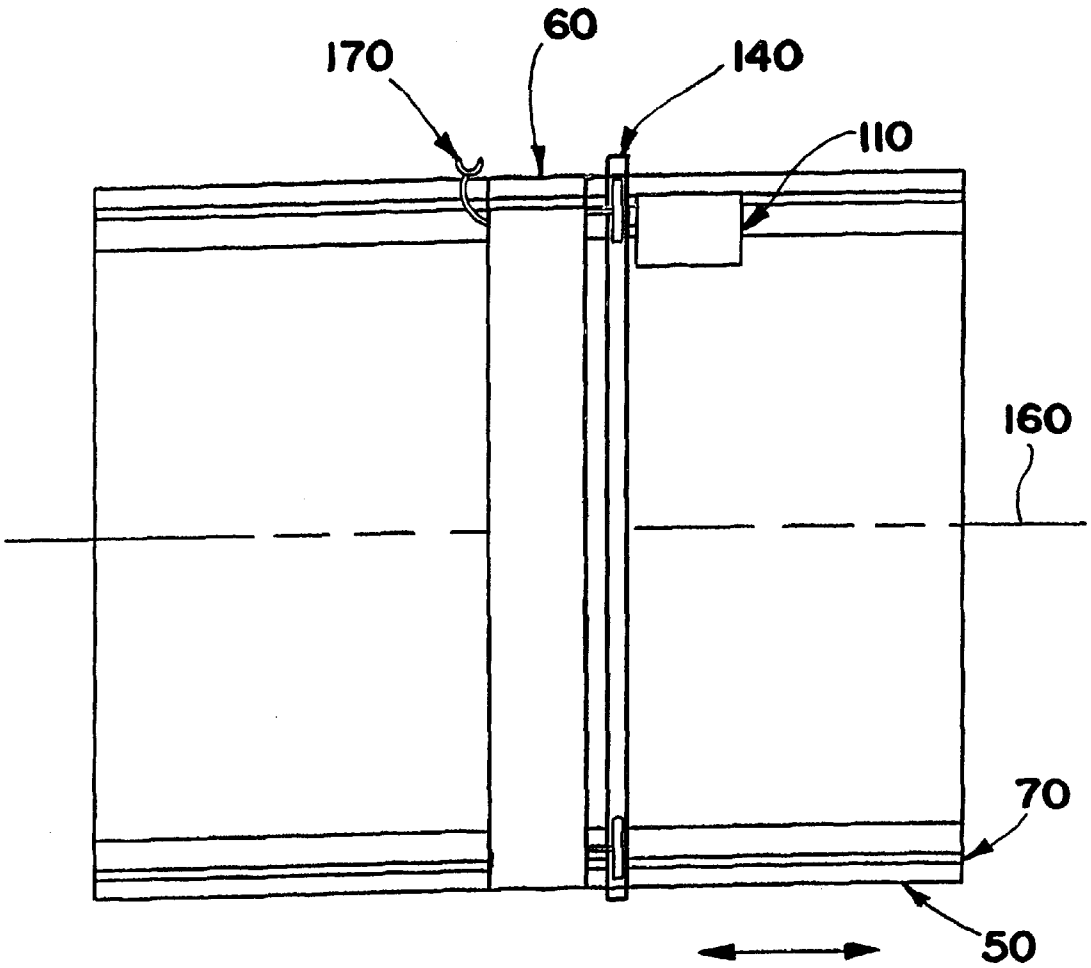
FIG. 4 is a top view of the wrapping machine shown in FIG. 1.
Figure 5:
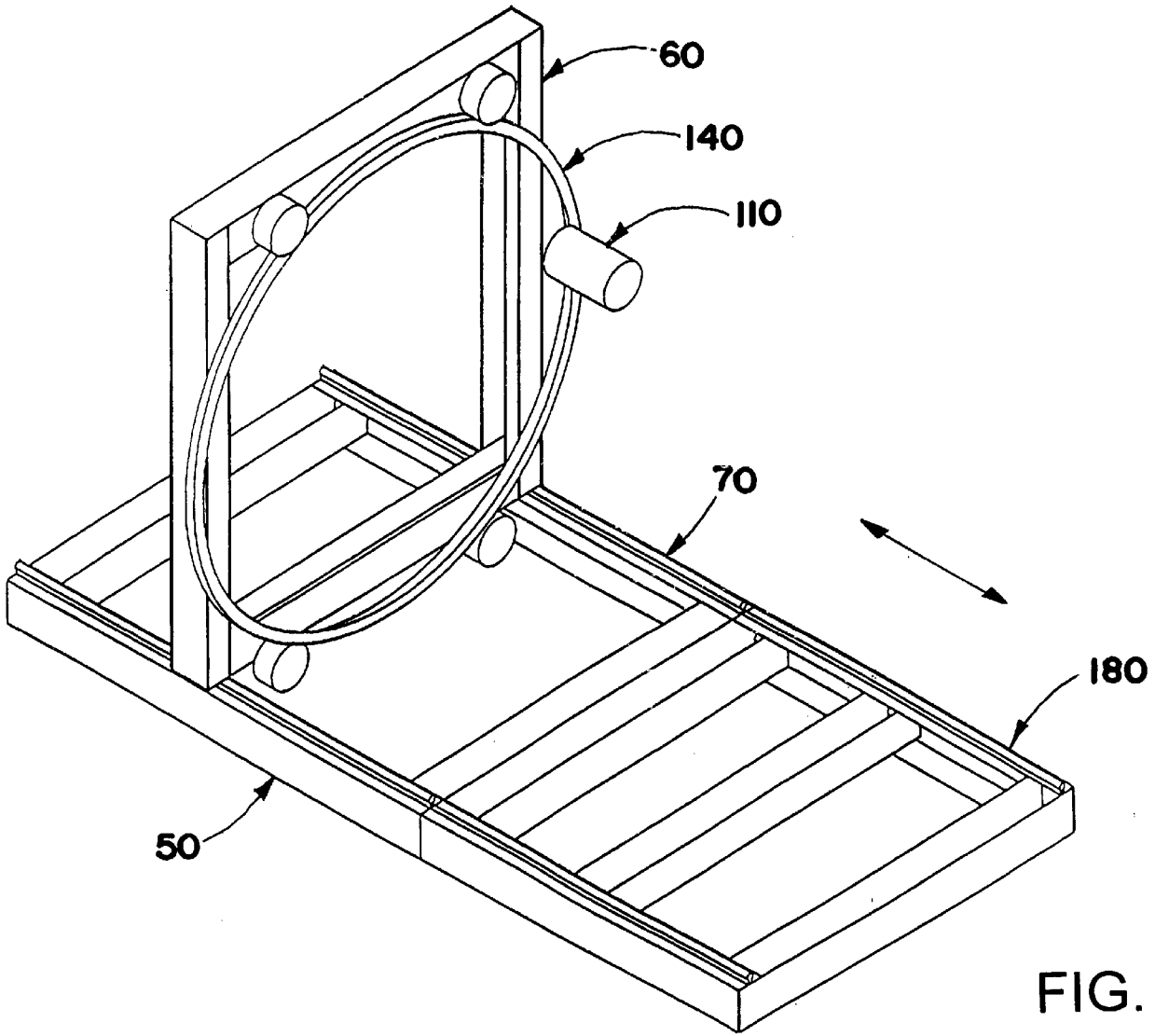
FIG. 5 is an isometric view of the wrapping machine of FIG. 1 with additional track added for wrapping longer loads without moving the load.

Referring to the drawings, an exemplary wrapping system 10 provided by the present invention is shown in FIGS. 1–5. The system 10 includes a wrapping machine 20 and a material handling device, such as a forklift truck 30, for moving and supporting a load 40 for wrapping. The load includes one or more goods, and may further include a pallet for supporting the goods thereon. The system and machine of the present invention facilitate securing the goods to the pallet to provide a more secure and stable load for storage and transport.

The wrapping machine 20 includes a base 50 and a carriage 60 movable back and forth along a travel direction relative to the base. The carriage can be moved manually or by any of a number of mechanical means, such as air cylinders, electric motors, chain drives, etc.

The base 50 generally rests on the floor or other surface and includes one or more rails 70 that form a track along which the carriage 60 moves. The rails support and guide the movement of the carriage thereon. The illustrated base includes a pair of laterally spaced parallel rails. The length of the rails affects the length of travel of the carriage thereon.

The base 50 also may include one or more wheels 80, as shown in the illustrated embodiment, to facilitate moving the machine 20. For example, the machine may be stored against a wall to conserve space and moved away from the wall for use. The wheels may also be used to reposition the machine relative to a load to facilitate wrapping the load, such as when the load is longer than the length of travel of the carriage, or when it is easier to move the machine to the load rather than moving the load to the machine. Additionally or alternatively, the base may include adjustable feet (not shown) for leveling the machine.

The carriage 60 supports a supply 90 of wrapping material for circumnavigation along a path around a load positioned within a wrapping space 100. The supply of wrapping material can include any material for wrapping objects to a pallet, including stretch wrap material, shrink wrap materials, cushioning wrap materials, decorative wrap materials, and adhesive wrap materials, for example. In the illustrated embodiment, the supply of wrapping material is a roll 110 of stretch wrap material. The roll 110 is supported for rotation by a dispenser 120 that can provide for adjustment of the tension on the stretch wrap as it is dispensed.

In the illustrated embodiment, the carriage 60 includes an upright frame 130, a ring 140 mounted to the frame for rotation relative to the frame, and the aforementioned dispenser 120, attached to the ring 140. The ring is supported by one or more rollers 150 for rotation about a generally horizontal axis 160 that is substantially parallel to the travel direction along which the carriage 60 moves relative to the base 50. Rotation of the ring defines a substantially vertical wrapping plane within which the stretch wrap dispenser moves as it traverses the path around the load 40. Since the ring effectively defines an orbital path for the stretch wrap, the illustrated machine may be referred to as an orbital stretch wrap machine.

The ring 140 is sized to accommodate loads of a predetermined height and width such that the load fits within the wrapping space 100 or volume, which is defined by the path of the roll 110 of stretch wrap and the length of travel of the carriage 60. However, the load may have a length dimension that is greater than the carriage's length of travel.

The roll 110 of stretch wrap may be moved either manually, automatically, or a combination thereof. For example, the system 10 may include a controller (not shown) for controlling movement of at least one of the ring 140 relative to the carriage 60 and the carriage relative to the base 50. At least one motor (not shown) generally is provided to drive rotation of the ring. Another motor may be provided to drive the carriage across the base. In an exemplary embodiment, only one motor is provided, to drive the rotation of the ring, and thus of the dispenser and the stretch wrap material. A handle 170 connected to the frame is provided to move the carriage 60 along the base 50, and may provide control of the motor that drives the ring 140 as well.

In operation, the carriage 60 is retracted to one end of the base 50, and the forklift truck 30 moves a load 40 within the wrapping space 100, generally in the direction of travel of the carriage, such that one end of the load is adjacent the dispenser 120. The operator then withdraws an end of the stretch wrap from the dispenser 120, secures it to the load and actuates rotation of the ring 140. Once the dispenser makes at least one revolution about the load, the operator moves the carriage in a forward direction along the track so that the stretch wrap is deposited about a subsequent portion of the load. The operator continues to move the carriage while the dispenser travels around the load until the load is wrapped or the carriage reaches the end of its travel, whichever comes first, at which point rotation of the dispenser is discontinued.

If the load 40 is longer than the length of travel, the carriage 60 is returned to its starting position by moving it in a reverse direction, the load is moved to place an unwrapped portion within the wrapping space 100, and the rotation of the ring 140 and dispenser 120 begins anew. This process is repeated until the load is completely wrapped. Alternatively, additional sections 180 can be added to the base 50 to increase the carriage's length of travel.

The load 40 is supported by the forklift truck 30 as it is wrapped. Since a forklift's tines generally support the load through slots in a pallet, the stretch wrap does not bind the load to the forklift.

In summary, the combined travel of the stretch wrap around the load and the travel of the carriage relative to the base provides a load having the goods thereof secured to the pallet, without regard to the length of the load. The length of the load is limited only by the material handling device's ability to support the load within the wrapping space. Since the machine does not have to carry the load, its design and construction can be simplified, making the machine cheaper to build and operate, and easier to transport and store.

Although the invention has been shown and described with respect to a certain illustrated embodiment, equivalent alterations and modifications will occur to others skilled in the art upon reading and understanding the specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function (i.e., that is functionally equivalent), even though not structurally equivalent to the disclosed structure which performs the function in the herein illustrated embodiment of the invention. For example, the carriage and the rails help to provide a means for moving the dispenser in a direction transverse to the wrapping plane, and the ring and frame help to provide a means for moving the dispenser along a path that defines a substantially vertical plane.

What is claimed is:

1. In combination, a machine for wrapping a load that extends into a wrapping space and a forklift truck for supporting the load at least partially within the wrapping space, the machine comprising: a base, a track mounted on the base, and a carriage mounted to the track, the track supporting and guiding the carriage for forward and reverse movement along a travel direction, the carriage including a frame and a dispenser for a packaging wrap material mounted to the frame for movement relative to the frame along a path that defines a substantially vertical wrapping plane that is transverse to the travel direction, wherein the wrapping space is defined by the path of the dispenser as it circumscribes the wrapping space and the length of travel of the carriage along the track, and the length of travel of the carriage along the track defines a length of the wrapping space.

2. A machine as set forth in claim 1, wherein the dispenser includes a roil of stretch wrap material.

3. A machine as set forth in claim 1, wherein the track includes a pair of parallel rails.

4. A machine as set forth in claim 1, wherein the carriage includes a ring rotatably mounted to the frame, and the dispenser is attached to the ring.

5. A machine as set forth in claim 4, wherein the ring defines an orbital path of the dispenser.

6. A machine as set forth in claim 1, wherein the frame includes a handle for moving the carriage along the track.

7. A method for wrapping a load, comprising: moving a dispenser of a packaging wrap material along a path that defines a substantially vertical wrapping plane; moving the dispenser in a travel direction transverse to the wrapping plane to define a wrapping space: and supporting a load at least partially within the wrapping space using a forklift truck; wherein moving the dispenser in the travel direction includes moving a carnage that supports the dispenser in a forward direction and a reverse direction opposite the forward direction along a track that guides the carriage as the carriage moves, while supporting the track on a base, and wherein moving the dispenser in the wrapping plane includes mounting the dispenser on a frame that is mounted on the carriage and moving the dispenser relative to the frame.

8. A method as set forth in claim 7, wherein moving the dispenser along a path includes rotating a ring to which the dispenser is attached about a substantially horizontal axis, the dispenser being attached to the ring.

9. A method as set forth in claim 8, wherein moving the dispenser in a travel direction transverse to the wrapping plane includes moving the ring in a direction perpendicular to the wrapping plane.

10. A method as set forth in claim 8, further comprising moving the load relative to the base and repeating the steps of moving the dispenser.

11. A method as set forth in claim 10, further comprising stopping rotation of the ring while moving the load.

12. A method as set forth in claim 7, further comprising moving the carriage that supports the dispenser in a reverse direction along the track prior to repeating the steps of moving the dispenser along a path that defines a substantially vertical wrapping plane and moving the dispenser in a travel direction transverse to the wrapping plane.

* * * * *

UNITED STATES PATENT AND TRADEMARK OFFICE

CERTIFICATE OF CORRECTION

PATENT NO. : 6,729,106 B2
DATED : May 4, 2004
INVENTOR(S) : Robert B. Wiley

It is certified that error appears in the above-identified patent and that said Letters Patent is hereby corrected as shown below:

Column 4,
Line 58, replace “roil” with -- roll --

Column 5,
Line 5, replace “space :” with -- space; --
Line 8, replace “carnage” with -- carriage --

Signed and Sealed this

Thirteenth Day of July, 2004

JON W. DUDAS
*Acting Director of the United States Patent and Trademark Office*